US006898870B1

(12) United States Patent
Rohde

(10) Patent No.: US 6,898,870 B1
(45) Date of Patent: May 31, 2005

(54) FOOTWEAR SOLE HAVING SUPPORT ELEMENTS WITH COMPRESSIBLE APERTURES

(75) Inventor: Mark W. Rohde, Scio, OR (US)

(73) Assignee: Nike, Inc., Beaverton, OR (US)

( * ) Notice: Subject to any disclaimer, the term of this patent is extended or adjusted under 35 U.S.C. 154(b) by 390 days.

(21) Appl. No.: 10/103,678

(22) Filed: Mar. 20, 2002

(51) Int. Cl.[7] ..... A43B 13/18; A43B 5/00
(52) U.S. Cl. ..... 36/28; 36/35 R; 36/37; 36/114
(58) Field of Search ..... 36/3 R, 3 B, 25 R, 36/28, 29, 114, 35 R, 35 B, 37

(56) References Cited

U.S. PATENT DOCUMENTS

| | | | | |
|---|---|---|---|---|
| 507,490 A | | 10/1893 | Gambino | |
| 607,086 A | | 7/1898 | Safford | |
| 622,673 A | | 4/1899 | Ferrata | |
| 933,422 A | | 9/1909 | Dee | |
| 949,754 A | | 2/1910 | Busky | |
| 1,094,211 A | | 4/1914 | Jenoi et al. | |
| 1,099,180 A | | 6/1914 | Karacsonyi | |
| 1,102,343 A | | 7/1914 | Kovacs | |
| 1,272,490 A | | 7/1918 | Matear | |
| 1,278,320 A | | 9/1918 | Ellithorpe | |
| 1,338,817 A | | 5/1920 | DeLuca | |
| 1,502,087 A | | 7/1924 | Bunns | |
| 1,670,747 A | | 5/1928 | Sestito | |
| 1,809,323 A | * | 6/1931 | Williams, Sr. | 36/3 R |
| 1,870,065 A | | 8/1932 | Nusser | |
| 1,870,114 A | | 8/1932 | Heller | |
| 1,932,557 A | * | 10/1933 | Meucci | 36/3 R |
| 2,104,924 A | | 1/1938 | Dellea | |
| 2,122,108 A | | 6/1938 | Modlin | |
| 2,198,228 A | | 4/1940 | Pinaud et al. | |
| 2,299,009 A | | 10/1942 | Denk | |
| 2,437,227 A | | 3/1948 | Hall | |
| 2,720,460 A | | 6/1955 | Stasinos | |
| 2,721,400 A | | 10/1955 | Israel | |
| 2,751,692 A | * | 6/1956 | Cortina | 36/3 B |
| 3,041,746 A | | 7/1962 | Rakus | |
| 3,429,545 A | | 2/1969 | Michel | |
| 3,822,490 A | | 7/1974 | Murawski | |

(Continued)

FOREIGN PATENT DOCUMENTS

| | | |
|---|---|---|
| CH | 570 130 | 9/1974 |

(Continued)

OTHER PUBLICATIONS

Article entitled "Hoop Dreams" (Applicant does not know the date of publication; however, he believes that the publication date for this reference is at least one year prior to the Mar. 20, 2002 filing date for the present application).

(Continued)

*Primary Examiner*—M. D. Patterson
(74) *Attorney, Agent, or Firm*—Banner & Witcoff, Ltd.

(57) ABSTRACT

The invention is an article of footwear having one or more support elements disposed in the sole. At least one of the support elements includes an aperture that increase the compliance of the sole. By selecting a specific aperture configuration for each support element, the compliance of each area of the footwear may be adjusted to conform to the demands of a particular application for the footwear. In addition, the footwear may include one or more plugs that are removably-received by the apertures to provide the wearer with control over the compliance characteristics of the sole.

62 Claims, 6 Drawing Sheets

U.S. PATENT DOCUMENTS

| | | | |
|---|---|---|---|
| 4,000,566 | A | 1/1977 | Famolare, Jr. |
| 4,030,213 | A | 6/1977 | Daswick |
| 4,074,446 | A | 2/1978 | Eisenberg |
| 4,223,457 | A | 9/1980 | Borgeas |
| 4,237,625 | A | 12/1980 | Cole et al. |
| 4,241,523 | A | 12/1980 | Daswick |
| 4,262,433 | A | 4/1981 | Hagg et al. |
| 4,267,648 | A | 5/1981 | Weisz |
| 4,271,606 | A | 6/1981 | Rudy |
| 4,271,607 | A | 6/1981 | Funck |
| 4,314,413 | A | 2/1982 | Dassler |
| 4,319,412 | A | 3/1982 | Muller et al. |
| 4,342,158 | A | 8/1982 | McMahon et al. |
| 4,364,188 | A | 12/1982 | Turner |
| 4,399,621 | A | 8/1983 | Dassler |
| 4,439,936 | A | 4/1984 | Clarke et al. |
| 4,492,046 | A | 1/1985 | Kosova |
| 4,494,321 | A | 1/1985 | Lawlor |
| 4,535,553 | A | 8/1985 | Derderian et al. |
| 4,536,974 | A | 8/1985 | Cohen |
| 4,546,555 | A | 10/1985 | Spademan |
| 4,559,366 | A | 12/1985 | Hostettler |
| 4,566,206 | A | 1/1986 | Weber |
| 4,592,153 | A | 6/1986 | Jacinto |
| 4,594,799 | A | 6/1986 | Lin |
| 4,598,484 | A | 7/1986 | Ma |
| 4,598,487 | A | 7/1986 | Misevich |
| 4,610,099 | A | 9/1986 | Signori |
| 4,616,431 | A | 10/1986 | Dassler |
| 4,624,010 | A | 11/1986 | Takebayashi |
| 4,638,575 | A | 1/1987 | Illustrato |
| 4,638,577 | A | 1/1987 | Riggs |
| 4,660,299 | A | 4/1987 | Omilusik |
| 4,680,875 | A | 7/1987 | Danieli |
| 4,680,876 | A | 7/1987 | Peng |
| 4,709,489 | A | 12/1987 | Welter |
| 4,715,130 | A | 12/1987 | Scatena |
| 4,722,131 | A | 2/1988 | Huang |
| 4,731,939 | A | 3/1988 | Parracho et al. |
| 4,733,483 | A | 3/1988 | Lin |
| 4,746,555 | A | 5/1988 | Luckanuck |
| 4,753,021 | A | 6/1988 | Cohen |
| 4,774,774 | A | 10/1988 | Allen, Jr. |
| D298,583 | S | 11/1988 | Yung-Mao |
| 4,794,707 | A | 1/1989 | Franklin et al. |
| 4,798,009 | A | 1/1989 | Colonel et al. |
| 4,802,289 | A | 2/1989 | Guldager |
| 4,815,221 | A | 3/1989 | Diaz |
| 4,843,737 | A | 7/1989 | Vorderer |
| 4,843,741 | A | 7/1989 | Yung-Mao |
| 4,845,863 | A | 7/1989 | Yung-Mao |
| 4,878,300 | A | 11/1989 | Bogaty |
| 4,881,328 | A | 11/1989 | Yung-Mao |
| 4,881,329 | A | 11/1989 | Crowley |
| 4,887,367 | A | 12/1989 | Mackness et al. |
| 4,905,382 | A | 3/1990 | Yung-Mao |
| 4,908,962 | A | 3/1990 | Yung-Mao |
| 4,910,884 | A | 3/1990 | Lindh et al. |
| 4,918,838 | A | 4/1990 | Chang |
| 4,936,029 | A | 6/1990 | Rudy |
| 4,956,927 | A | 9/1990 | Misevich et al. |
| 4,984,376 | A | 1/1991 | Walter et al. |
| D315,634 | S | 3/1991 | Yung-Mao |
| 5,005,300 | A | 4/1991 | Diaz et al. |
| 5,014,449 | A | 5/1991 | Richard et al. |
| 5,068,981 | A | 12/1991 | Jung |
| 5,086,574 | A * | 2/1992 | Bacchiocchi ..... 36/35 R |
| 5,092,060 | A | 3/1992 | Frachey et al. |
| 5,138,776 | A | 8/1992 | Levin |
| 5,222,312 | A | 6/1993 | Doyle |
| 5,233,767 | A | 8/1993 | Kramer |
| 5,343,639 | A | 9/1994 | Kilgore et al. |
| 5,353,523 | A | 10/1994 | Kilgore et al. |
| 5,560,126 | A * | 10/1996 | Meschan et al. ..... 36/42 |
| 5,572,804 | A | 11/1996 | Skaja et al. |
| 5,685,090 | A | 11/1997 | Tawney et al. |
| 5,782,014 | A | 7/1998 | Peterson |
| 5,853,844 | A | 12/1998 | Wen |
| 5,976,451 | A | 11/1999 | Skaja et al. |
| 6,018,889 | A | 2/2000 | Friton |
| 6,055,747 | A | 5/2000 | Lombardino |
| 6,115,944 | A | 9/2000 | Lain |
| 6,131,310 | A | 10/2000 | Fang |
| D433,216 | S | 11/2000 | Avar et al. |
| 6,233,846 | B1 | 5/2001 | Sordi |
| 6,305,100 | B1 | 10/2001 | Komarnycky et al. |
| 6,487,796 | B1 * | 12/2002 | Avar et al. ..... 36/28 |
| 6,562,427 | B2 * | 5/2003 | Hung ..... 428/36.9 |

FOREIGN PATENT DOCUMENTS

| | | |
|---|---|---|
| DE | 806647 | 2/1949 |
| DE | 1485654 | 1/1965 |
| DE | 3400997 | 7/1985 |
| ES | 2080933 | 1/1990 |
| ES | 1036287 | 1/1997 |
| FR | 465267 | 4/1914 |
| FR | 1227420 | 4/1960 |
| FR | 2556188 | 6/1985 |
| GB | 21794 | 7/1903 |
| GB | 7163 | 10/1906 |
| GB | 2 032 761 | 5/1980 |
| GB | 2 173 987 A | 10/1986 |
| JP | 146188 | 11/1990 |
| SU | 1586637 A1 | 12/1989 |
| WO | WO 03/043455 | 5/2003 |

OTHER PUBLICATIONS

Advertisement for Aura "Introducing the exciting new performance driven 2001 Aura".

Web page translation using babelfish, entitled "The tennis shoe with the motivating force" (Applicant does not know the date of publication; however, he believes that the publication date for this reference is at least one year prior to the Mar. 20, 2002 filing date for the present application).

FWN, vol. 40, No. 38, Sep. 17, 1990, "Marco Scalena puts spring in Athlon wearers' control".

Spring- and Shock-Absorber Bearing Spring Elements, Springing Comfort with High Damping (Applicant does not know the date of publication; however, he believes that the publication date for this reference is at least one year prior to the Mar. 20, 2002 filing date for the present application).

Activ Power Spring System catalog, front and back pages with English translation of back page.

International Search Report, PCT/US03/06770, mailing date; Jul. 18, 2003.

US 4,974,345, 12/1990, Yung-Mao (withdrawn)

* cited by examiner

FOOTWEAR SOLE HAVING SUPPORT ELEMENTS WITH COMPRESSIBLE APERTURES

BACKGROUND OF THE INVENTION

1. Field of the Invention

The present invention relates to footwear. The invention concerns, more particularly, athletic shoes having one or more support elements with a mechanism for varying the stiffness characteristics of the sole.

2. Description of Background Art

Modern articles of athletic footwear include a highly-refined combination of elements that each perform a specific function directed toward maximizing athletic performance. The two primary elements of athletic footwear are an upper and a sole. The upper is formed of leather, synthetic materials, or a combination thereof and comfortably receives the foot while providing ventilation and protection from the elements. The sole includes multiple layers that are conventionally referred to as an insole, midsole, and outsole. The insole is a thin, padded member located adjacent to the foot that improves the comfort of the footwear. The midsole forms the middle layer of the sole and often incorporate a resilient foam material, such as polyurethane, phylon, or ethyl vinyl acetate, that attenuates shock and absorbs energy when the footwear makes contact with the ground. The outsole is fashioned from a durable, wear resistant material, such as carbon-black rubber compound, and includes a textured lower surface to improve traction.

An alternate midsole design, disclosed in U.S. Pat. Nos. 5,353,523 and 5,343,639 to Kilgore et al., and hereby incorporated by reference, includes four foam columns placed between rigid top and bottom plates. FIG. 1 depicts a similar, commercially-available article of footwear 10 that includes an upper 12 which is attached to a sole structure 14. Sole structure 14 incorporates an outsole 16 and a midsole 18 that includes four elastomeric support elements 20, a semi-rigid heel plate 22, a base plate 24, and a midfoot wedge 26. In addition, midsole 18 may include a cushioning layer located above heel plate 22 that extends throughout the longitudinal length of footwear 10 and enhances the comfort of footwear 10.

Support elements 20 are the primary component that attenuates shock and absorbs energy when footwear 10 initially contacts the ground in the heel area, during walking or running, for example. Each support element may include a band 28 circumscribing the outer surface and may have an interior void that extends longitudinally from the upper to lower surface. The compliance of each support element 20 may be altered by repositioning band 28. For example, each support element 20 may be configured for greatest compliance by positioning band 28 adjacent either the top or bottom. Least compliance is achieved by centrally-locating band 28, as depicted in FIG. 1. By altering the compliance of support elements 20, an individual may configure footwear 10 to have proper shock attenuation and energy absorption for the particular weight of the individual. In addition, alterations in the compliance of support elements 20 may be utilized to configure footwear 10 for differing activities or playing surfaces. The present invention relates to an alternate method of altering the compliance of support elements, such as support elements 20.

BRIEF SUMMARY OF THE INVENTION

The present invention is an article of footwear having an upper and a sole structure. The upper receives a foot of a wearer and the sole structure is attached to the upper. The sole structure includes at least one discrete support element with a columnar structure. The support element has an upper surface and a lower surface that are secured to the footwear, and the support element has an exposed exterior surface that defines an aperture in the support element. The sole may also include multiple support elements, each support element or selected support elements having an aperture.

The primary purpose of the aperture is to tune the compliance of the support element. By configuring the aperture to have a specific configuration, the compliance of the support element may be altered accordingly. Multiple factors may be considered when configuring a aperture. For example, the aperture may extend entirely through the support element or only partially through; the aperture may be tapered; the shape of the aperture may vary; and the orientation of the shape may vary. Accordingly, the aperture may have many possible configurations that vary depending upon the specific application for which the footwear is intended to be used.

To provide the wearer with the ability to customize the compliance of each support element, plugs may be inserted into the apertures. A plug formed of the same material as the support element and having the same shape as the aperture will generally configure the support element to have the same compliance as a solid support element. A plug formed of a material with a lesser stiffness will provide an intermediate compliance. In addition, the plug may be used to change the shape of the aperture or alter the orientation of the aperture.

The concepts discussed above may be applied to a variety of footwear types. For example, support elements with apertures may be utilized in running shoes to reduce the rate at which the foot pronates. Alternatively, apertures may be incorporated into a walking shoe sole to provide greater compliance in the heel area than in other areas of the sole.

The advantages and features of novelty that characterize the present invention are pointed out with particularity in the appended claims. To gain an improved understanding of the advantages and features of novelty that characterize the present invention, however, reference should be made to the descriptive matter and accompanying drawings which describe and illustrate various embodiments of the invention.

BRIEF DESCRIPTION OF THE DRAWINGS

FIG. 31 is an elevational view of a fifth support element.

DETAILED DESCRIPTION OF THE INVENTION

Figure 1:
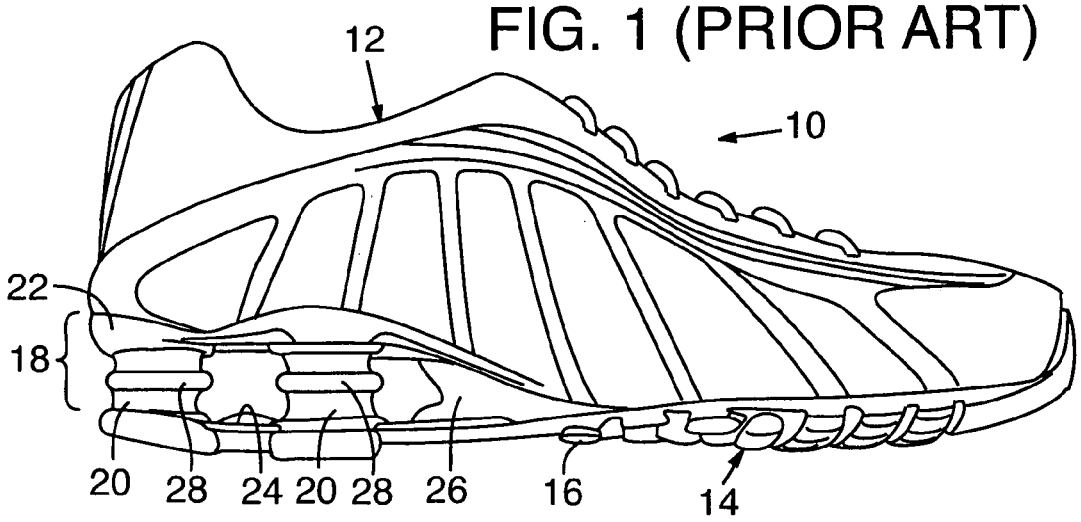
FIG. 1 (PRIOR ART)
FIG. 1 is a lateral elevational view of a prior art article of footwear.

Referring to the drawings, wherein like numerals indicate like elements, articles of footwear having a midsole in accordance with the present invention are disclosed. The figures illustrate only the article of footwear intended for use on the left foot of a wearer. One skilled in the art will recognize that a right article of footwear, such article being the mirror image of the left, is intended to fall within the scope of the present invention.

Figure 2A:
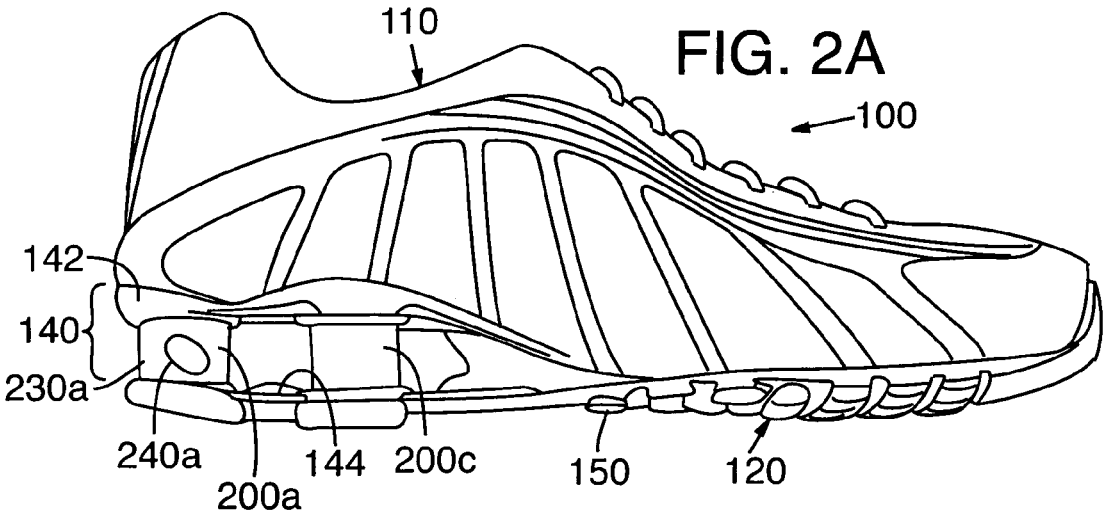
FIG. 2A is a lateral elevational view of an article of footwear that includes a support element in accordance with a first embodiment of the present invention.
Figure 2B:
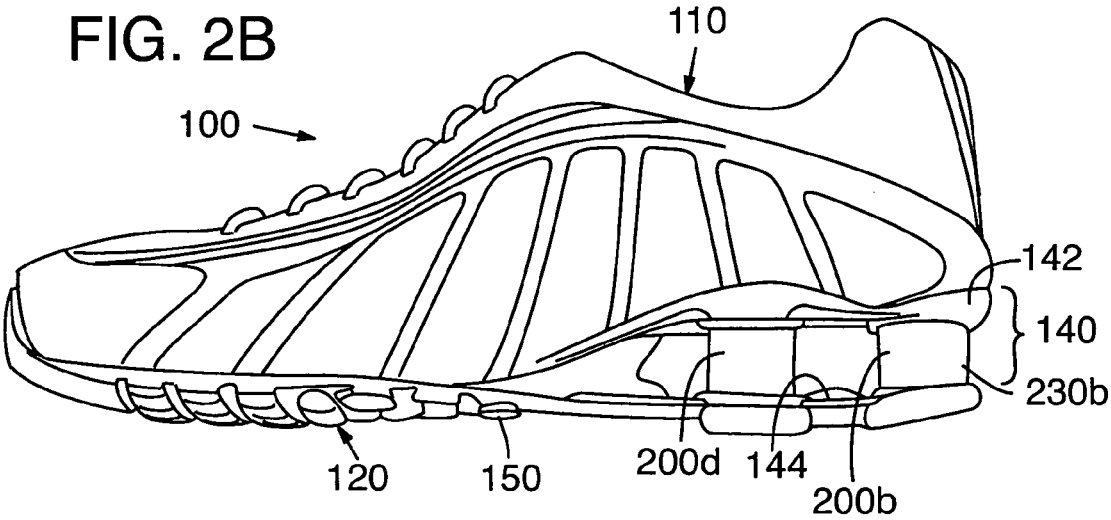
FIG. 2B is a medial elevational view of the article of footwear depicted in FIG. 2A.

Referring to FIGS. 2A and 2B, an article of footwear 100, having a design in accordance with a first embodiment of the present invention, is depicted. Footwear 100 is an article of athletic footwear, particularly a running shoe. The concepts disclosed in reference to footwear 100, however, may be applied to any style of footwear, including a walking shoe, tennis shoe, basketball shoe, loafer, dress shoe, sandal, hiking boot, or work boot.

The primary elements of footwear 100 are an upper 110 that is attached in a conventional manner to a sole structure 120. Upper 110 receives and comfortably secures footwear 100 to a foot of a wearer. Sole structure 120, which is generally disposed between the foot of the wearer and the ground, attenuates shock and absorbs energy when footwear 100 repetitively contacts the ground during athletic activity.

As with conventional articles of athletic footwear, sole structure 120 includes an insole (not depicted) located within upper 110, a midsole 140, and an outsole 150. Midsole 140 is attached to upper 110 and functions as the primary shock-attenuating and energy-absorbing component of footwear 100. Outsole 150 is attached to the lower surface of midsole 140 and may be formed of a durable, wear-resistant polymer. The lower surface of outsole 150 may include texturing to provide enhanced traction when contacting the ground.

The primary elements of midsole 140 are a heel plate 142, a base plate 144, and four discrete elastomeric support elements 200. Heel plate 142 is located adjacent to upper 110 in the heel portion of footwear 100. In addition to providing a firm surface that supports the heel region of the wearer's foot, heel plate 144 distributes the forces associated with impact among support elements 200. Base plate 144 is disposed between support elements 200 and outsole 150. The purpose of base plate 144 is to provide a semi-rigid base for support elements 200 and, like heel plate 142, distribute forces among support elements 200. In alternate embodiments of the invention, elements such as heel plate 142 and base plate 144 may be absent from footwear 100 or combined with other elements.

The number and position of support elements 200 may be varied to suit the needs of the particular application for which the footwear is intended to be used. With regard to footwear 100, four discrete support elements 200 are located as follows: support element 200*a* is located in the rear-lateral corner of footwear 100; support element 200*b* is located in the rear-medial corner of footwear 100; support element 200*c* is located on the lateral side of footwear 100 and forward of support element 200*a*; and support element 200*d* is located on the medial side of footwear 100 and forward of support element 200*b*.

Each support element 200 includes an upper surface 210 that is attached to heel plate 144, a lower surface 220 that is attached to base plate 146, and an exposed exterior surface 230 that extends between upper surface 210 and lower surface 220. In addition, each support element 200 may include an interior void that also extends along a longitudinal axis of support element 200 and between upper surface 210 and lower surface 220. As depicted in FIG. 2, each support element 200 has a generally cylindrical configuration. Within the scope of the present invention, however, support elements 200 may have a variety of other columnar configurations, including spherical, pyramidal, cubic, or other non-regular shape.

Materials that are suitable for support elements 200 include rubber, polyurethane foam, or phylon, for example. Another suitable material is a microcellular foam having a specific gravity of 0.5 to 0.7 g/cm$^3$, a hardness of 70 to 76 on the Asker C scale, and a stiffness of 110 to 130 kN/m at 60% compression may be utilized. Although many materials may be utilized, support elements 200 will provide enhanced performance if the material returns energy in the range of at least 35 to 70%, as measured in a drop ball rebound test. In addition, the material selected may have sufficient durability to maintain structural integrity when repeatedly compressed from 50 to 70% of its natural height in excess of 500,000 cycles, for example. Alternatively, a microcellular elastomeric foam of the type disclosed in U.S. Pat. Nos. 5,353,523 and 5,343,639 to Kilgore et al., which have been incorporated by reference and discussed in the Background of the Invention herein, may be utilized.

An advantageous aspect of support element 200*a* is the presence of an aperture 240*a* that extends from a lateral side of exterior surface 230*a*, through the center of support element 200*a*, and to a medial side of exterior surface 230*a*, thereby forming a hole or aperture that extends through support element 200*a*. The general purpose of configuring support element 200*a* to include channel 240*a* is to alter the compression characteristics of midsole 140. More particularly, the purpose of aperture 240*a* is to alter the compliance, or ability to deform under a compressive force, of support element 200*a*. Assuming that support elements 200 are substantially identical in materials and dimensions, then the presence of aperture 240*a* provides support element 200*a* with greater compliance than the remaining support elements 200. Accordingly, a compressive force directed along a vertical axis of support element 200*a* will impart a greater degree of compressive deformation than an equal compressive force acting upon support elements 200*b*–200*d*. The greater compressive deformation may be utilized, among other purposes, to reduce the rate at which the foot pronates during running. An aperture 240 that is similar to aperture 240*a* may be formed in any support element 200. Additionally, a single support element 200 may include multiple apertures 240.

Another method by which the compliance of an individual support element 200 may be increased is to decrease the thickness of support element 200. Decreasing thickness, however, also decreases the stability of support element 200 by increasing the probability that support element 200 will buckle when subjected to a compressive load. Accordingly, the present invention utilizes an alternate method of increasing compliance without decreasing stability, the addition of aperture 240.

With many individuals, the typical motion of the foot during running proceeds as follows: First, the heel strikes the ground, followed by the ball of the foot. As the heel leaves the ground, the foot rolls forward such that the toes make contact, and finally the entire foot leaves the ground to begin another cycle. While in contact with the ground, the foot typically rolls from the outside or lateral side to the inside or medial side, a process called pronation. That is, normally the outside of the heel strikes first and the toes on the inside of the foot leave the ground last. While the foot is airborne and preparing for another cycle, the opposite process, called supination, occurs. Pronation, the inward roll of the foot while in contact with the ground, although normal, can be a potential source of foot and leg injury, particularly if it is excessive.

As noted, support element 200*a* is positioned in the rear-lateral corner of footwear 100 and, based on the pronation discussion above, is located in the portion of sole structure 120 that initially experiences ground reaction forces upon contact between footwear 100 and the ground. Consequently, support element 200*a* will experience more significant compressive forces than the remaining support elements 200 during initial impact. As the foot pronates (rolls to the medial side) and simultaneously rolls forward, impact forces will then be transferred to support elements 200*b* and 200*c*, and thereafter to support element 200*d*. If support element 200*a*, is more compliant than other support elements, particularly support elements 200*b* and 200*d*, then the lateral side of footwear 100 will generally have a greater overall compliance than the medial side of footwear 100, thereby resulting in a configuration that reduces the rate at which the foot pronates as forces are transferred from the lateral to medial side while footwear 100 is in contact with the ground.

Reducing the rate of pronation, however, is not the only benefit that may be gained from apertures 240. In addition, apertures 240 may be utilized to alter the compression characteristics of support elements 200 so as to provide sole structure 120 with greater shock-attenuation or energy-absorption capabilities, increased stability, and a reduction in the overall weight of footwear 100. In addition, changes in the size and orientation of an aperture may be utilized to configure footwear 100 for a person having a specific weight. In order to achieve these or other benefits many factors should be considered, including the number of support elements 200, the specific location of each support element 200, the number of apertures 240, and the configuration of each aperture 240. The particular configuration of each aperture 240 has the effect of determining the specific characteristics of support elements 200 and the overall characteristics of sole structure 120. Within the scope of the present invention, the configuration of apertures 240 may vary considerably. Factors having an effect upon the compression characteristics include penetration distance, degree of tapering, shape, size, and orientation of apertures 240. With respect to FIG. 2, aperture 240*a* has an elliptical cross-section, extends entirely through support element 240*a*, and is not tapered. One skilled in the art, however, will recognize that a variety of aperture 240 configurations may be employed to increase the compliance of support element 1200*a*, thereby increasing the cushioning that footwear 100 provides the individual.

Figure 3A:
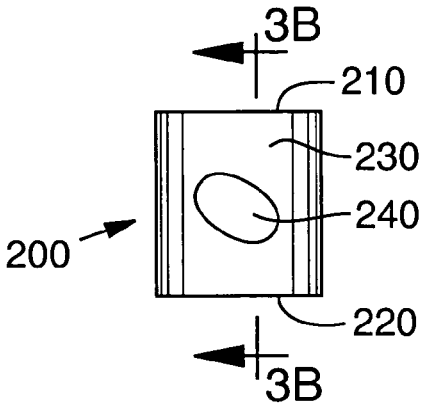
FIG. 3A is an elevational view of a first support element.
Figure 3B:
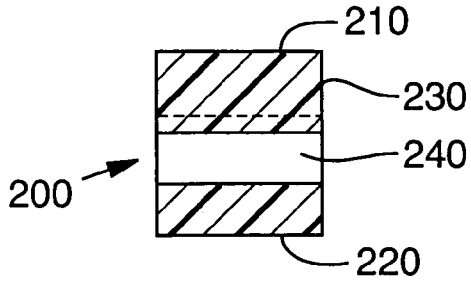
FIG. 3B is a cross-sectional view taken along line 3B—3B in FIG. 3A.
Figure 3C:
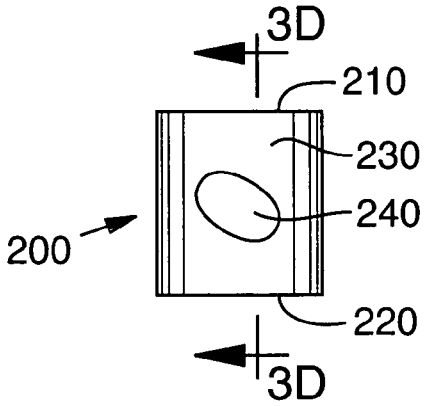
FIG. 3C is an elevational view of a second support element.
Figure 3D:
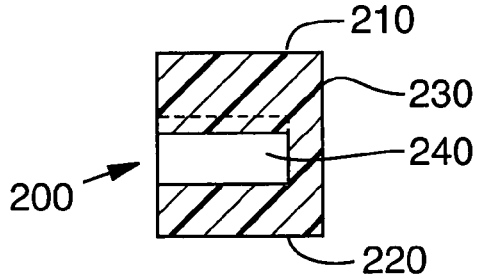
FIG. 3D is a cross-sectional view taken along line 3D—3D in FIG. 3C.
Figure 3E:
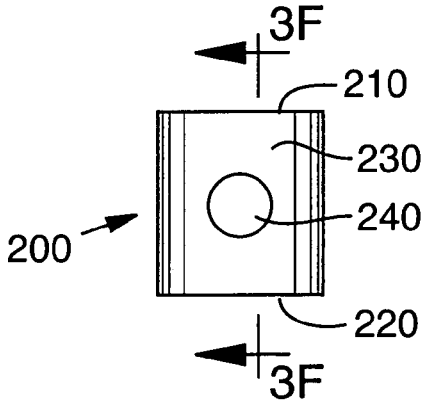
FIG. 3E is an elevational view of a third support element.
Figure 3F:
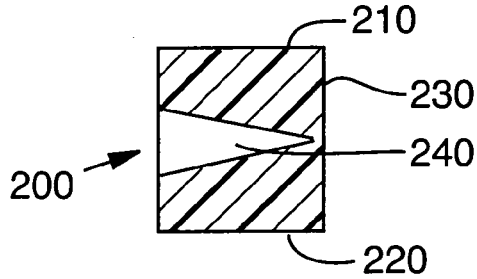
FIG. 3F is a cross-sectional view taken along line 3F—3F in FIG. 3E.

Regarding penetration depth, an individual aperture 240 may be configured to penetrate entirely through a support element 200, thereby imparting uniform compression characteristics across support element 200, or only partially through support element 200. Partial penetration depths may be used in applications where an advantage is gained from having non-uniform compression characteristics across support element 200. Non-uniform compression characteristics may be utilized where, for example, one side of support element 210 is intended to compress to a greater degree than the opposite side. Similarly, aperture 240 may have a tapered configuration wherein one side has a greater cross-sectional area than the opposite side. To illustrate these concepts, FIGS. 3A to 3F depict various support elements 200 that are similar to support element 200*a* in FIG. 2. FIGS. 3A and 3B depict a aperture 240 that extends entirely through support element 200 and is not tapered; FIGS. 3C and 3D depict a aperture 240 that extends partially through a support element 200; and FIGS. 3E and 3F depict a support element 200 with a tapered aperture 240.

Figure 3G:
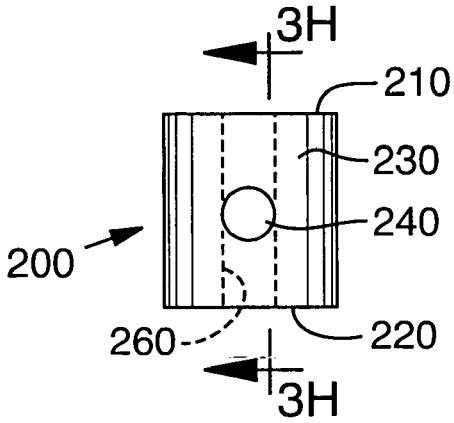
FIG. 3G is an elevational view of a fourth support element.
Figure 3H:
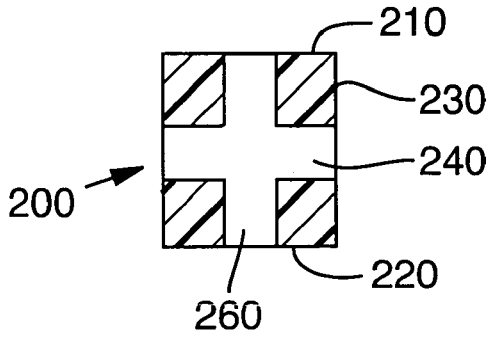
FIG. 3H is a cross-sectional view taken along line 3H—3H in FIG. 3G.
Figure 3I:
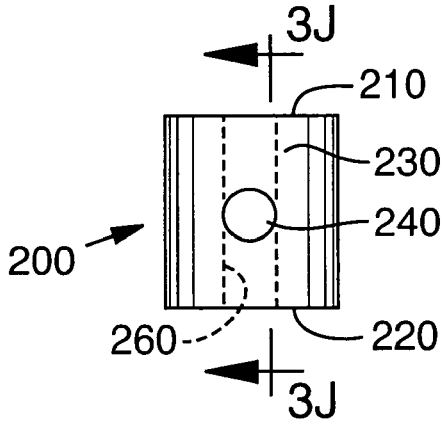
FIG. 3J is a cross-sectional view taken along line 3J—3J in FIG. 3I.
Figure 3J:
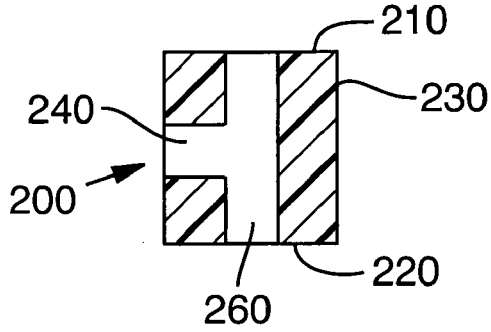
Figure 4A:
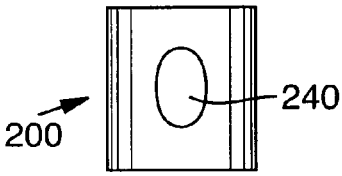
FIGS. 4A to 4M depict support elements having a variety of aperture shapes and orientations.
Figure 4E:
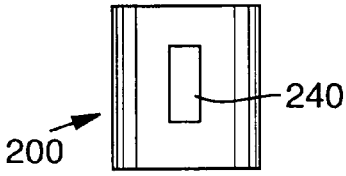
Figure 4I:
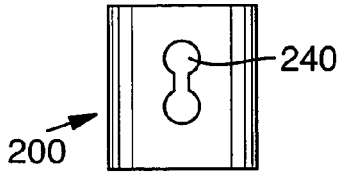
Figure 4B:
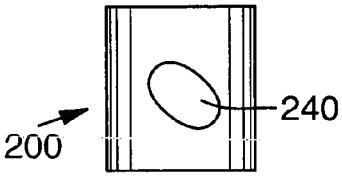
Figure 4F:
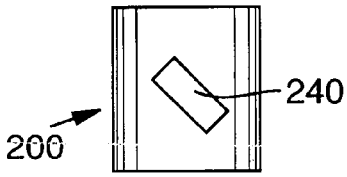
Figure 4J:
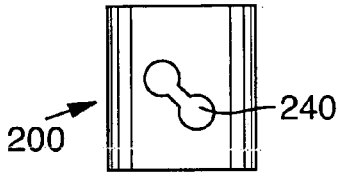
Figure 4C:
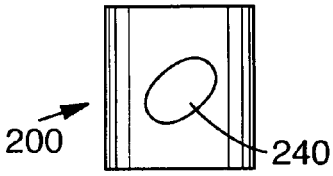
Figure 4G:
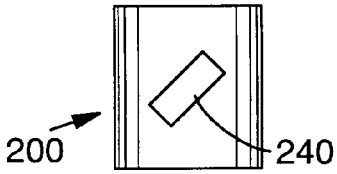
Figure 4K:
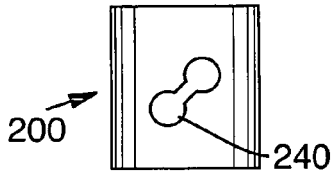
Figure 4D:
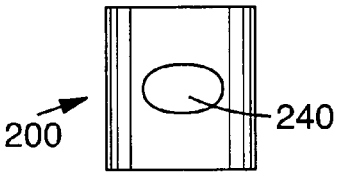
Figure 4H:
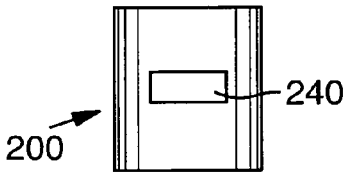
Figure 4L:
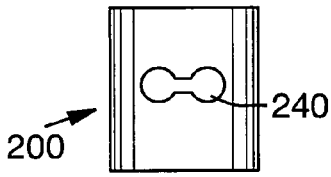
Figure 4M:
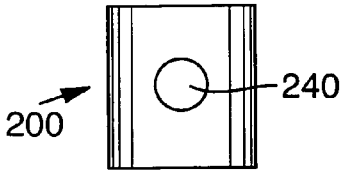

As discussed in the Description of Background Art section, support elements may have an interior void that extends longitudinally from the upper to lower surface. Referring to FIGS. 3G to 3J, two support elements 200 having an interior void 260 that extends from upper surface 210 to lower surface 220 are depicted. FIGS. 3G and 3H depict a support element 200 having a aperture 240 that extends entirely through support element 200 and an interior void 260. Similarly, FIGS. 31 and 3J depict a support element 200 having a aperture 240 that extends partially through support element 200 and an interior void 260. Accordingly, the compression characteristics of support elements 200 may be affected by other changes to the geometry or structure, such as the inclusion of interior void 200.

A further factor that affects the compression characteristics is the shape of aperture 240. As depicted in FIG. 2, aperture 240 has an elliptical shape. Other suitable shapes include circular, rectangular, and dog bone (two circular areas connected by a slot), for example. The size and proportions may also be altered. For example, a circular aperture 240 may have a 4, 8, or 12 millimeter diameter. Finally, the orientation of the shape may be altered. For example, an elliptical aperture 240 may be oriented such that the foci are aligned horizontally, vertically, or diagonally. Consequently, many factors may be considered when determining the optimum configuration. Examples of aperture shapes and orientations are depicted in FIG. 4.

In order to determine, through experimental analysis, the effect of selected shapes and orientations discussed above, a variety of support elements 200 with a diameter of approximately 21 millimeters were repeatedly impacted at a velocity of 0.7 meters per second with a 4 centimeter diameter, cylindrically-shaped impact head having a mass of 7.8 kilograms. The support elements 240 had a variety of aperture 240 configurations, including a 4, 8, and 12 millimeter diameter circular apertures 240; elliptical apertures 240 having 8 and 12 millimeter axes, the foci being aligned vertically, at 45 degrees, and horizontally; dog bone shaped apertures 240 that were aligned vertically, at 45 degrees, and horizontally; and narrow, rectangular apertures 240 with a length of 12 millimeters and aligned vertically, at 45 degrees, and horizontally. As a control, a support element 200 without a aperture 240 was also tested. In general, the testing indicated that support elements 200 having the 4 millimeter circular shaped aperture 240, the rectangular slot, and the dog bone shape were only slightly more compliant than the support element 200 without a aperture 240. Also, testing indicated that the shape of aperture 240 has a greater effect upon compliance than the orientation, the most compliant shape being the elliptically-shaped apertures 240.

A variety of individuals having different characteristics, such as mass or running style, may each utilize footwear having apertures 240 formed in support elements 200. Accordingly, each individual may require support elements 200 having different configurations of aperture 240, thereby configuring the footwear for the specific needs of each, unique individual. For example, those individuals with relatively large masses may find that a aperture 240 that imparts lesser compliance is most appropriate. An individual having a relatively small mass, however, may find that a aperture 240 that imparts greater compliance is most appropriate. In addition, those individuals that pronate to a greater degree than other individuals may find that a sole with greater medial stiffness is most appropriate. Accordingly, apertures 240 may be added to support elements 200 that are located on a lateral side of the footwear. The configuration of apertures 240, therefore, may vary significantly within the scope of the present invention to accommodate individuals with differing characteristics or footwear requirements.

Figure 5A:
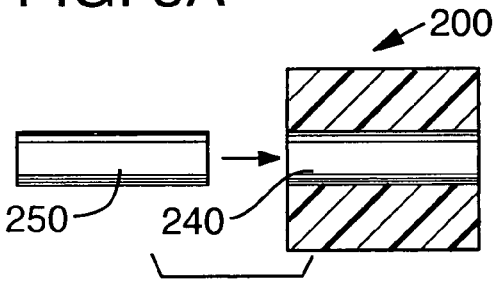
FIGS. 5A to 5C are partial cross-sectional exploded views of support elements that include a plug.
Figure 5B:
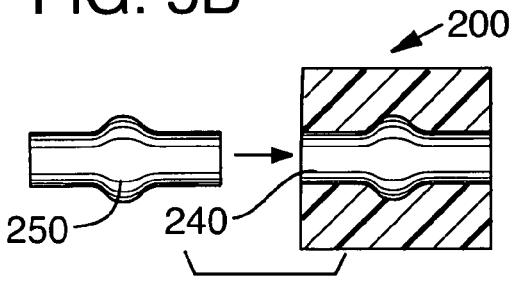
Figure 5C:
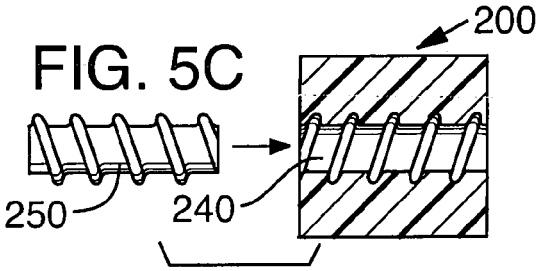

Support elements 200 with greater compliance may be more appropriate for hard playing surfaces, such as concrete or asphalt, but support elements 200 with lesser compliance may be more appropriate for softer playing surfaces, such as turf. The use of a plug 250, as depicted in FIG. 5A, permits individuals to quickly alter the compliance of support elements 200. Plug 250 has the approximate dimensions of aperture 240 and may, consequently, be inserted into aperture 240. A locking mechanism, such a protrusion on plug 250 that mates with an indentation in aperture 240, which is depicted in FIG. 5B, may be added to ensure that plug 250 remains securely positioned. Similarly, the locking mechanism may include threads on plug 250 that mate with corresponding threads in aperture 240, as depicted in FIG. 5C. As described above, the absence of material in aperture 240 is primarily responsible for the increase in compliance. By inserting plug 250, aperture 240 gains support and the compliance of support element 200 is decreased. The material used to form plug 250 also has an effect upon the compliance. A plug 250 that is formed of the same material as support element 200 will generally configure support element 200 to have the compliance of a solid support element 200 (e.g., a support element 200 without aperture 240). A plug 250 that is formed of a material that is less compliant than the material forming support element 200 will then impart a lesser degree of compliance.

Figure 5D:
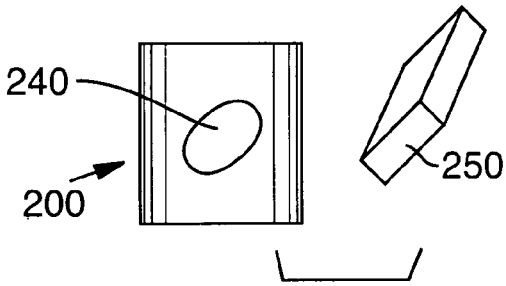
FIGS. 5D to 5G are perspective views of support elements having plugs that modify aperture shapes and orientations.
Figure 5E:
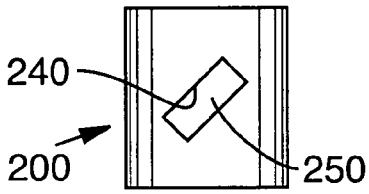
Figure 5F:
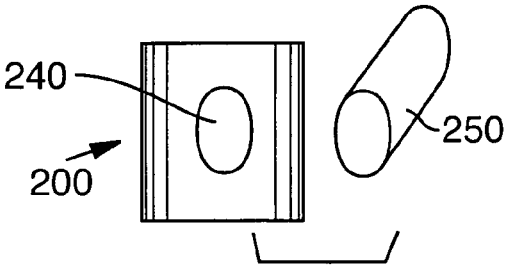
Figure 5G:
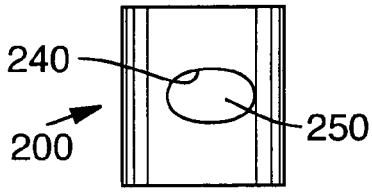

Plug 250 may also be utilized to distort the shape of aperture 240, thereby altering the compliance of support element 200. Experimental testing, as discussed above, indicated that the shape of aperture 240 has an effect upon compliance. Accordingly, plug 250 may be utilized to distort an elliptical aperture 240 into a rectangular aperture 240, as depicted in FIGS. 5D and 5E, thereby reducing overall compliance. A plug may also be utilized to alter the orientation of an aperture 240. For example, an elliptical plug 250 may be inserted into an elliptical aperture 240 that is oriented to have greater height than width, as depicted in FIG. 5F. Plug 250 may then be rotated 90 degrees, as depicted in FIG. 5G, to alter the orientation of aperture 240 to have greater width than height.

Figure 6:
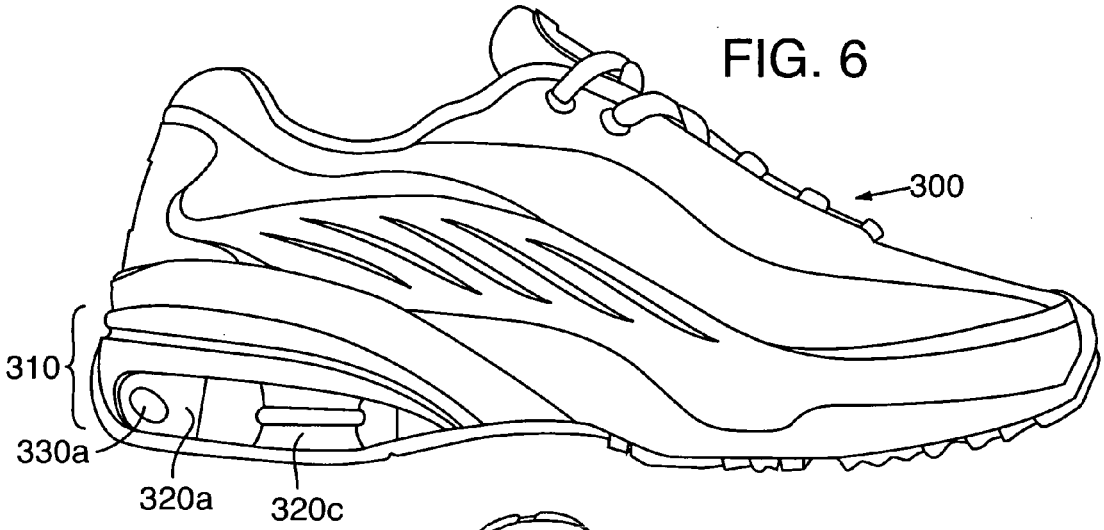
FIG. 6 is a lateral elevational view of an article of footwear that includes support elements in accordance with a second embodiment of the present invention.
Figure 7:
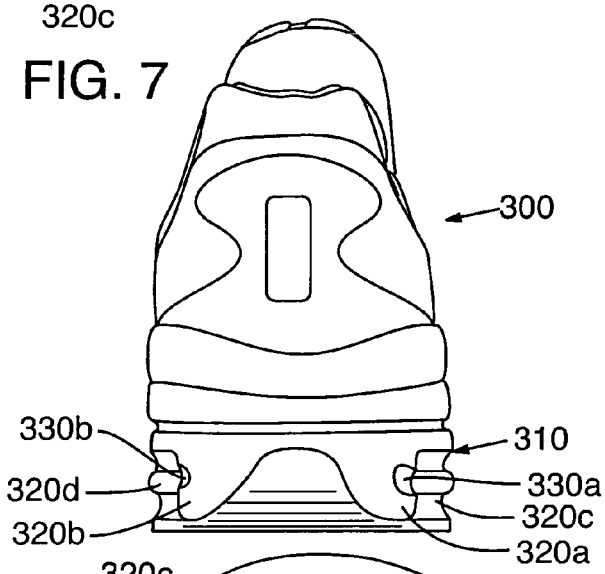
FIG. 7 is a back elevational view of the article of footwear depicted in FIG. 6.
Figure 8:
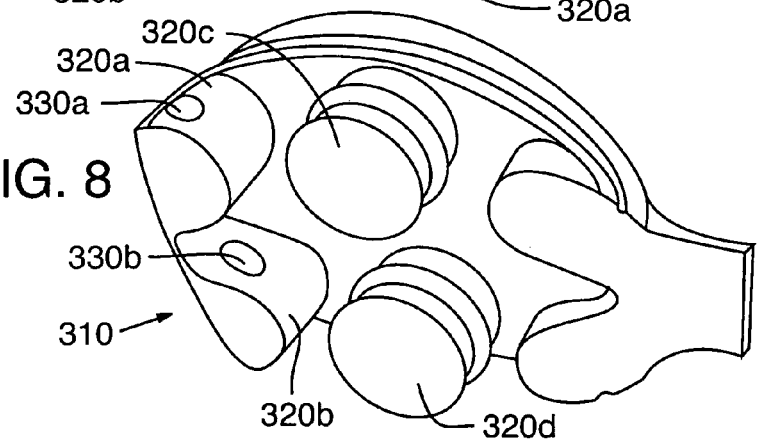
FIG. 8 is a perspective view of a support component from the article of footwear depicted in FIG. 6.

A second embodiment of the present invention is disclosed in FIGS. 6 to 8. Footwear 300 is a walking shoe that includes a support component 310 having four support elements 320. In the first embodiment, support elements 200 were individual components. Support elements 320 of the second embodiment, however, are integrally formed with a common upper surface that may incorporate a depression for receiving the heel.

During running, the rear-lateral corner of an article of footwear typically makes initial contact with the ground, as discussed above. During walking, however, initial contact usually occurs across the rear portion of the footwear. Consequently, footwear 300 includes apertures 330, which are elliptically-shaped, in both rear support elements 320*a* and 320*b*. To increase stability of footwear 300, support elements 320*a* and 320*b* are partially connected, as depicted in FIG. 8. In addition, the rear portion of support component 310 is rounded to permit footwear 300 and the foot to smoothly rotate forward following initial contact with the ground. As with the first embodiment, support elements 320 may have a variety of aperture 330 configurations and may include one or more plugs 250 that permit the wearer to adjust compression properties.

The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

That which is claimed is:

1. An article of footwear comprising:

an upper for receiving a foot of a wearer; and a sole structure attached to said upper, said sole structure including at least a first support element and a second support element with a columnar structure, said first support element and said second support element being discrete and having an upper surface and a lower surface that are secured to said footwear, and said first support element having an exposed exterior surface and an aperture with a depth extending into said first support element from said exterior surface, said depth being greater than a width and a height of said aperture at said exterior surface.

2. The article of footwear of claim 1, wherein said sole structure includes a midsole and an outsole, said first support element being located in said midsole.

3. The article of footwear of claim 1, where said sole structure includes a third support element and a fourth support element, said third and fourth support elements being discrete and having a columnar structure.

4. The article of footwear of claim 3, wherein said support elements are located in a heel portion of said sole structure.

5. The article of footwear of claim 4, wherein said support elements are arranged such that said first support element is located on a lateral side of said footwear; said second support element is located on a medial side of said footwear; said third support element is located forward of said first support element; and said fourth support element is located forward of said second support element.

6. The article of footwear of claim 1, wherein said aperture extends through said first support element.

7. The article of footwear of claim 1, wherein a shape of said aperture is elongate.

8. The article of footwear of claim 1, wherein said height of said aperture is greater than said width of said aperture.

9. The article of footwear of claim 1, wherein said width of said aperture is greater than said height of said aperture.

10. The article of footwear of claim 1, wherein a shape of said aperture is selected from a group consisting of elliptical, circular, and rectangular.

11. The article of footwear of claim 1, wherein said aperture is elliptical.

12. The article of footwear of claim 1, wherein said first support element includes an interior void that extends along at least a portion of a longitudinal length of said first support element.

13. The article of footwear of claim 12, wherein said interior void intersects said aperture.

14. The article of footwear of claim 1, wherein said first support element is located in a rear lateral portion of said sole structure to decrease a compliance of said rear lateral portion.

15. The article of footwear of claim 1, wherein said first support element includes at least a first plug formed of a first material, said first plug being configured to be removably-received by said aperture.

16. The article of footwear of claim 15, wherein said first support element includes a locking mechanism that securely positions said plug.

17. The article of footwear of claim 15, wherein a shape of said first plug is different than a shape of said aperture to alter the shape of said aperture.

18. The article of footwear of claim 15, wherein said first plug is rotatable within said aperture to alter an orientation of said aperture.

19. The article of footwear of claim 15, wherein said first support element includes a second plug, said first plug being formed of a first material and said second plug being formed of a second material, said first material being less compliant than said second material.

20. An article of footwear comprising:

an upper for receiving a foot of a wearer; and a sole structure having a midsole and an outsole, said midsole being attached to said upper and including at least a first support element and a second support element with a columnar structure, said first support element and said second support element being discrete and having an upper surface and a lower surface that are secured to said footwear, and said first support element having an exposed exterior surface and an aperture with a depth extending into said first support element from said exterior surface, said depth being rater than a width and a height of said aperture at said exterior surface, and said first support element having an interior void that extends along at least a portion of a longitudinal length of said first support element.

21. The article of footwear of claim 20, where said sole structure includes a third support element and a fourth support element, said third and fourth support elements being discrete and having a columnar structure.

22. The article of footwear of claim 21, wherein said support elements are located in a heel portion of said sole structure.

23. The article of footwear of claim 22, wherein said support elements are arranged such that said first support element is located on a lateral side of said footwear, said second support element is located on a medial side of said footwear; said third support element is located forward of said first support element; and said fourth support element is located forward of said second support element.

24. The article of footwear of claim 20, wherein said aperture extends through said first support element.

25. The article of footwear of claim 20, wherein a shape of said aperture is elongate.

26. The article of footwear of claim 20, wherein said height of said aperture is greater than said width of said aperture.

27. The article of footwear of claim 20, wherein said width of said aperture is greater than said height of said aperture.

28. The article of footwear of claim 20, wherein a shape of said aperture is selected from a group consisting of elliptical, circular, and rectangular.

29. The article of footwear of claim 20, wherein said aperture is elliptical.

30. The article of footwear of claim 20, wherein said first support element is located in a rear lateral portion of said sole structure to decrease a compliance of said rear lateral portion.

31. The article of footwear of claim 20, wherein said first support element includes at least a first plug formed of a first material, said first plug being configured to be removably-received by said aperture.

32. The article of footwear of claim 31, wherein said first support element includes a locking mechanism that securely positions said plug.

33. The article of footwear of claim 31, wherein a shape of said first plug is different than a shape of said aperture to alter the shape of said aperture.

34. The article of footwear of claim 31, wherein said first plug is rotatable within said aperture to alter an orientation of said aperture.

35. The article of footwear of claim 31, wherein said first support element includes a second plug, said first plug being formed of a first material and said second plug being formed of a second material, said first material being less compliant than said second material.

36. An article of footwear comprising:

an upper for receiving a foot of a wearer; and a sole structure having a midsole and an outsole, said midsole being attached to said upper and including at least four discrete and columnar support elements that are distributed throughout at least a heel portion of said footwear, said support elements including a first support element, said first support element having an exposed exterior surface and an aperture with a depth extending into said first support element from said exterior surface, said depth being greater than a width and a height of said aperture at said exterior surface.

37. The article of footwear of claim 36, wherein said support elements include:

said first support element, which is located on a lateral side of said footwear, a second support element, which is located on a medial side of said footwear, a third support element, which is located on said lateral side and forward of said first support element, and a fourth support element, which is located on said medial side and forward of said second support element.

38. The article of footwear of claim 36, wherein said aperture extends through said first support element.

39. The article of footwear of claim 36, wherein a shape of said aperture is elongate.

40. The article of footwear of claim 36, wherein said width of said aperture is greater than said height of said aperture.

41. The article of footwear of claim 36, wherein a shape of said aperture is selected from a group consisting of elliptical, circular, and rectangular.

42. The article of footwear of claim 36, wherein said aperture is elliptical.

43. The article of footwear of claim 36, wherein said first support element includes an interior void that extends along at least a portion of a longitudinal length of said first support element.

44. The article of footwear of claim 43, wherein said interior void intersects said aperture.

45. The article of footwear of claim 36, wherein said first support element includes at least a first plug formed of a first material, said first plug being configured to be removably-received by said aperture.

46. The article of footwear of claim 45, wherein said first support element includes a locking mechanism that securely positions said plug.

47. The article of footwear of claim 45, wherein a shape of said first plug is different than a shape of said aperture to alter the shape of said aperture.

48. The article of footwear of claim 45, wherein said first plug is rotatable within said aperture to alter an orientation of said aperture.

49. The article of footwear of claim 45, wherein said first support element includes a second plug, said first plug being formed of a first material and said second plug being formed of a second material, said first material being less compliant than said second material.

50. An article of footwear comprising:

an upper for receiving a foot of a wearer; and a sole structure having a midsole and an outsole, said midsole being attached to said upper and having a plurality of discrete and columnar support elements, including:

a first support element located in a heel portion of said footwear and on a lateral side of said footwear, a second support element located in said heel portion of said footwear and on a medial side of said footwear, a third support element located on said lateral side and forward of said first support element, and a fourth support element located on said medial side and forward of said second support element, each of said support elements having an upper surface, a lower surface, and an exposed exterior surface, said upper surface and said lower surface being attached to said footwear, and at least one said exterior surface defining an aperture in one said support element, said aperture reducing a compliance of said one said support element than a width and a height of said aperture at said exterior surface.

51. The article of footwear of claim 50, wherein said one said support element is said first support element.

52. The article of footwear of claim 50, wherein a shape of said aperture is elongate.

53. The article of footwear of claim 50, wherein said width of said aperture is greater than all said height of said aperture.

54. The article of footwear of claim 50, wherein a shape of said aperture is selected from a group consisting of elliptical, circular, and rectangular.

55. The article of footwear of claim 50, wherein said aperture is elliptical.

56. The article of footwear of claim 50, wherein said one said support element includes at least a first plug formed of a first material, said first plug being configured to be removably-received by said aperture.

57. The article of footwear of claim 56, wherein said one said support element includes a locking mechanism that securely positions said plug.

58. The article of footwear of claim 56, wherein a shape of said first plug is different tan a shape of said aperture to alter the shape of said aperture.

59. The article of footwear of claim 56, wherein said first plug is rotatable within said aperture to alter an orientation of said aperture.

60. The article of footwear of claim 56, wherein said one said support element includes a second plug, said first plug being formed of a first material and said second plug being formed of a second material, said first material being less compliant than said second material.

61. An article of footwear comprising:

an upper for receiving a foot of a wearer; and a sole structure having a midsole and an outsole, said midsole being attached to said upper and including at least four discrete and columnar support elements that are distributed throughout at least a heel portion of said footwear, said support elements including a first support element, said first support element having an exposed exterior surface and an aperture extending into said first support element from said exterior surface, a height of said aperture being greater than a width of said aperture.

62. An article of footwear comprising:

an upper for receiving a foot of a wearer; and a sole structure having a midsole and an outsole, said midsole being attached to said upper and having a plurality of discrete and columnar support elements, including:

a first support element located in a heel portion of said footwear and on a lateral side of said footwear, a second support element located in said heel portion of said footwear and on a medial side of said footwear, a third support element located on said lateral side and forward of said first support element, and a fourth support element located on said medial side and forward of said second support element, each of said support elements having an upper surface, a lower surface, and an exposed exterior surface, said upper surface and said lower surface being attached to said footwear, and at least one said exterior surface defining an aperture in one said support element, said aperture reducing a compliance of said one said support element, and a height of said aperture being greater than a width of said aperture.

* * * * *